US009316026B2

(12) United States Patent
Myers et al.

(10) Patent No.: US 9,316,026 B2
(45) Date of Patent: Apr. 19, 2016

(54) PROTECTIVE CASE FOR PHYSICALLY SECURING A PORTABLE ELECTRONIC DEVICE

(71) Applicant: ACCO Brands Corporation, Lake Zurich, IL (US)

(72) Inventors: Stephen Myers, Redwood City, CA (US); Jonathan Corpuz, Fremont, CA (US); Jonathan Stacey, Vancouver (CA)

(73) Assignee: ACCO Brands Corporation, Lake Zurich, IL (US)

( * ) Notice: Subject to any disclaimer, the term of this patent is extended or adjusted under 35 U.S.C. 154(b) by 0 days.

(21) Appl. No.: 14/524,671

(22) Filed: Oct. 27, 2014

(65) Prior Publication Data

US 2015/0040621 A1 Feb. 12, 2015

Related U.S. Application Data

(63) Continuation of application No. 13/450,801, filed on Apr. 19, 2012, now Pat. No. 8,869,573.

(60) Provisional application No. 61/496,981, filed on Jun. 14, 2011.

(51) Int. Cl.
*E05B 69/00* (2006.01)
*E05B 73/00* (2006.01)

(52) U.S. Cl.
CPC ..... *E05B 73/0005* (2013.01); *E05B 73/00* (2013.01); *E05B 73/0082* (2013.01); (Continued)

(58) Field of Classification Search
CPC . E05B 73/00; E05B 73/0017; E05B 73/0023; E05B 73/0082; E05B 2073/0088; Y10T 70/40; Y10T 70/402; Y10T 70/50; Y10T 70/5004; Y10T 70/5009
USPC ..... 70/14, 15, 57, 57.1, 58
See application file for complete search history.

(56) References Cited

U.S. PATENT DOCUMENTS 2,460,474 A 2/1949 Soref et al.
2,489,484 A 11/1949 Dyson
(Continued)

FOREIGN PATENT DOCUMENTS

CN 101689722 A 3/2010
DE 9215866 U1 1/1993
DE 202010011923 1/2011

OTHER PUBLICATIONS

"International Search Report and Written Opinion of PCT/US2012/039414 mailed on Aug. 7, 2012, 8 pages."
(Continued)

*Primary Examiner* — Christopher Boswell
(74) *Attorney, Agent, or Firm* — Michael Best & Friedrich LLP

(57) ABSTRACT

A security apparatus for a portable electronic device is provided. The security apparatus may include a plurality of shell portions, each shaped to wrap around part of a perimeter of the portable electronic device. The security apparatus may further include a connecting portion that engages at least one of the plurality of shell portions and to thereby couple the plurality of shell portions to each other. At least one of the connecting portion and one or more of the plurality of shell portions may include an attachment device, the attachment device being configured to engage with a locking head, thereby locking relative positions of the plurality of shell portions and the connecting portion.

17 Claims, 10 Drawing Sheets

(52) U.S. Cl.
CPC ..... *Y10T29/49826* (2015.01); *Y10T 70/40* (2015.04); *Y10T 70/402* (2015.04); *Y10T 70/50* (2015.04); *Y10T 70/5009* (2015.04)

(56) References Cited

U.S. PATENT DOCUMENTS

| | | | | |
|---|---|---|---|---|
| 2,673,458 | A | 3/1954 | Schlage | |
| 4,005,279 | A | 1/1977 | Richter | |
| 4,252,007 | A | 2/1981 | Kerley | |
| 4,471,409 | A | 9/1984 | Dittrich | |
| 4,667,491 | A | 5/1987 | Lokken et al. | |
| 4,884,420 | A | 12/1989 | Finkel et al. | |
| 4,937,860 | A | 6/1990 | Smith | |
| 4,993,244 | A | 2/1991 | Osman | |
| 5,154,456 | A | 10/1992 | Moore et al. | |
| 5,169,114 | A * | 12/1992 | O'Neill | 70/58 |
| 5,375,440 | A | 12/1994 | Patterson | |
| 5,531,082 | A | 7/1996 | Wolk et al. | |
| 5,709,110 | A | 1/1998 | Greenfield et al. | |
| 5,836,183 | A | 11/1998 | Derman | |
| 5,918,491 | A | 7/1999 | Maxwell et al. | |
| 6,065,408 | A | 5/2000 | Tillim et al. | |
| 6,081,974 | A | 7/2000 | McDaid | |
| 6,082,156 | A | 7/2000 | Bin | |
| 6,082,601 | A | 7/2000 | Standish | |
| 6,125,669 | A | 10/2000 | McDaid et al. | |
| 6,170,304 | B1 | 1/2001 | Ohta | |
| 6,178,089 | B1 | 1/2001 | Alfonso et al. | |
| 6,182,169 | B1 | 1/2001 | Force, Sr. et al. | |
| 6,212,921 | B1 | 4/2001 | Knighton | |
| 6,237,375 | B1 | 5/2001 | Wymer | |
| 6,321,905 | B1 * | 11/2001 | Sykes | 206/1.5 |
| 6,374,648 | B1 | 4/2002 | Mitsuyama | |
| 6,418,014 | B1 | 7/2002 | Emerick, Jr. | |
| 6,427,499 | B1 | 8/2002 | Derman | |
| 6,529,381 | B1 | 3/2003 | Schoenfish | |
| 6,578,394 | B2 | 6/2003 | Yin | |
| 6,659,274 | B2 * | 12/2003 | Enners | G06F 1/1626 206/305 |
| 6,711,921 | B1 | 3/2004 | Yang | |
| 6,763,690 | B2 | 7/2004 | Galant | |
| 6,905,024 | B1 | 6/2005 | Cao et al. | |
| 6,948,343 | B2 | 9/2005 | Williamson | |
| 7,028,513 | B2 | 4/2006 | Avganim | |
| 7,029,133 | B2 | 4/2006 | Challis | |
| 7,121,125 | B2 | 10/2006 | Murray, Jr. et al. | |
| 7,174,752 | B2 | 2/2007 | Galant | |
| 7,191,623 | B2 | 3/2007 | Francke | |
| 7,204,106 | B2 | 4/2007 | Merrem et al. | |
| 7,236,588 | B2 | 6/2007 | Gartrell | |
| 7,274,564 | B2 | 9/2007 | Rossini | |
| 7,299,668 | B1 | 11/2007 | Lu | |
| 7,305,858 | B1 | 12/2007 | Wu | |
| 7,315,443 | B2 * | 1/2008 | Allen | 361/679.55 |
| 7,409,915 | B2 | 8/2008 | Hagar | |
| 7,443,665 | B2 | 10/2008 | Allen | |
| 7,499,269 | B2 | 3/2009 | Allen | |
| 7,499,270 | B2 | 3/2009 | Allen | |
| 7,526,931 | B2 | 5/2009 | Burdett et al. | |
| 7,535,799 | B2 | 5/2009 | Polany et al. | |
| 7,594,576 | B2 | 9/2009 | Chen et al. | |
| 7,647,796 | B2 | 1/2010 | Francke | |
| 7,724,520 | B2 * | 5/2010 | Allen | 70/58 |
| 7,778,023 | B1 | 8/2010 | Mohoney | |
| 7,870,766 | B2 | 1/2011 | Sedon et al. | |
| 7,907,394 | B2 * | 3/2011 | Richardson | G06F 1/1613 312/223.1 |
| 7,966,851 | B2 | 6/2011 | Sedon et al. | |
| 7,983,034 | B1 | 7/2011 | Mohoney | |
| 7,997,106 | B2 | 8/2011 | Mahaffey et al. | |
| 8,001,812 | B2 | 8/2011 | Mahaffey et al. | |
| 8,191,851 | B2 * | 6/2012 | Crown | 70/58 |
| 8,418,514 | B1 | 4/2013 | Su | |
| 8,464,563 | B2 | 6/2013 | Perez et al. | |
| 8,503,170 | B1 * | 8/2013 | Hsu | G06F 1/1626 206/320 |
| 8,783,073 | B1 | 7/2014 | Derman | |
| 8,813,528 | B2 | 8/2014 | Olear et al. | |
| 8,833,117 | B2 * | 9/2014 | Yang | 70/58 |
| 8,867,198 | B2 * | 10/2014 | Steele | A45C 11/00 206/320 |
| 8,869,573 | B2 | 10/2014 | Myers et al. | |
| 8,935,943 | B2 * | 1/2015 | Derman | 70/58 |
| 9,025,317 | B2 * | 5/2015 | Richardson | H04M 1/0252 361/679.01 |
| 9,060,580 | B2 * | 6/2015 | Tages | A45C 11/00 |
| 9,101,188 | B2 * | 8/2015 | Magness | G06F 1/1656 |
| 2002/0134119 | A1 | 9/2002 | Derman | |
| 2003/0164010 | A1 * | 9/2003 | Galant | 70/58 |
| 2004/0177658 | A1 | 9/2004 | Mitchell | |
| 2004/0182119 | A1 | 9/2004 | Lax et al. | |
| 2005/0247584 | A1 | 11/2005 | Lu | |
| 2005/0268672 | A1 | 12/2005 | Fraser et al. | |
| 2008/0072633 | A1 | 3/2008 | Samuel | |
| 2010/0079285 | A1 | 4/2010 | Fawcett et al. | |
| 2011/0072863 | A1 | 3/2011 | Mahaffey et al. | |
| 2011/0077061 | A1 | 3/2011 | Danze et al. | |
| 2011/0080137 | A1 | 4/2011 | Avganim | |
| 2011/0170257 | A1 | 7/2011 | Allen | |
| 2011/0187531 | A1 | 8/2011 | Oehl et al. | |
| 2012/0079858 | A1 | 4/2012 | Perez et al. | |
| 2012/0234055 | A1 | 9/2012 | Bland et al. | |
| 2014/0060125 | A1 | 3/2014 | Yang | |
| 2014/0118930 | A1 * | 5/2014 | Sedon | E05B 73/0082 361/679.56 |
| 2014/0126230 | A1 | 5/2014 | Harris | |
| 2014/0130554 | A1 | 5/2014 | Su | |
| 2014/0226298 | A1 * | 8/2014 | Palmer | H05K 5/0208 361/807 |

OTHER PUBLICATIONS

"International Search Report and Written Opinion of PCT/US2012/039418 mailed on Jul. 27, 2012, 9 pages."

Author Unknown, "iPad Enclosures: Fits all iPads," Maclocks.com, no date, retrieved from http://www.maclocks.com/index.php/ipad-enclosure-ipad-mount-ipad-kiosk.html on Jul. 5, 2012, 5 pages.

Author Unknown, "iPad2 Lock: No. 1 Selling iPad lock," Maclocks.com, no date, retrieved from http://www.maclocks. com/index.php/i-pad-lock.html on Jul. 5, 2012, 5 pages.

"Author Unknown,""iPad2 Lock and Security Case Bundle—World's best sellingiPad Cable Lock,""Maclocks.com, no date, retrieved from http://www.maclocks.com/index.php/imac-locks/ipad-2-security-case-and-lockbundle.htmi?SID=a597a3f687e6073ba8274dfecb625f56 on Jul. 5, 2012, 3 pages."

* cited by examiner

PROTECTIVE CASE FOR PHYSICALLY SECURING A PORTABLE ELECTRONIC DEVICE

CROSS-REFERENCES TO RELATED APPLICATIONS

The present application is a continuation of U.S. patent application Ser. No. 13/450,801, filed on Apr. 19, 2012, now U.S. Pat. No. 8,869,573, which claims the benefit of priority of U.S. Provisional Application No. 61/496,981, filed on Jun. 14, 2011, the entire contents of both of which are hereby incorporated by reference in their entirety for all purposes.

BACKGROUND

Embodiments of the present invention relate to devices for inhibiting the theft of relatively small but expensive pieces of equipment, such as iPads™, iPhones™, similar mobile computing devices, tablets, laptops, or electronic devices without a security slot (e.g., a Kensington® security slot).

Electronic devices are commonly used for a variety of applications. Many electronic devices are small and valuable, making them attractive to steal. One way to deter computer theft is to provide a small, generally rectangular slot in a wall of a computer. A security apparatus with a locking head may be secured to the computer via the rectangular slot. However, many electronic devices do not include this rectangular slot. For example, iPhones™ and iPads™, each of which may retail for hundreds of dollars, do not include this rectangular slot. Owners may desire to nonetheless secure these devices to a semi-permanent or permanent fixture.

Embodiments of the invention address these and other problems, individually and collectively.

BRIEF SUMMARY

Embodiments of the invention relate to security apparatuses, as well as methods for making and using security apparatuses.

In some embodiments, a security apparatus for a portable electronic device is provided. The security apparatus may include a plurality of shell portions, each shaped to wrap around part of a perimeter of the portable electronic device. The security apparatus may further include a connecting portion that engages at least one of the plurality of shell portions and to thereby couple the plurality of shell portions to each other. At least one of the connecting portion and one or more of the plurality of shell portions may include an attachment device, the attachment device being configured to engage with a locking head, thereby locking relative positions of the plurality of shell portions and the connecting portion. The locking head may be coupled to a cable. The locking head may be independent from the shell portions and may be independent from the connecting portion. The locking head may be configured to change from a locked state to an unlocked state upon completed entry of a security feature into the locking head. The plurality of shell portions may be configured to, in total, cover a substantial portion of a back of the portable electronic device when the portions are assembled around the portable electronic device. Another of the connecting portion and one or more of the plurality of shell portions may include an aperture that aligns with the attachment device when the plurality of shell portions and the connecting portions are assembled around the portable electronic device. The connecting portion may be configured to be positioned on at least part of at least two of the plurality of shell portions.

The connecting portion may include the attachment device. One of the plurality of shell portions may include the attachment device. One or more of the plurality of shell portions may include one or more tracks, and the connecting portion may include one or more runners complementary to the one or more tracks. The plurality of shell portions, in some instances, do not comprise the connecting portion. The connecting portion may include a bar with a length-to-width aspect ratio greater than about 1.5.

In some embodiments, a method of securing a portable electronic device is provided. The method may include positioning each of a plurality of shell portions to surround a respective part of a perimeter of the electronic device. The method may further include engaging a connecting portion with each of the plurality of shell portion. The method may also include locking a locking head to an attachment device, thereby restricting relative movement of each of the plurality of shell portions relative to each other, wherein at least one of the connecting portion and one or more of the plurality of shell portions comprises the attachment device. Upon engagement of the connecting portion with each of the plurality of shell portions, the attachment device may extend through an aperture in another of the connecting portion and one or more of the plurality of shell portions. The method may further include coupling the locking head with an immovable object prior to locking the locking head to the attachment device. Coupling the locking head with the immovable object may include wrapping a cable coupled to the locking head around the immovable object. The method may also include unlocking the locking head from the attachment device by entering a security feature into the locking head.

In some embodiments, a security apparatus for a portable electronic device is provided. The security apparatus may include: a plurality of interconnecting frame portions that assemble to interconnect and at least partly enclose the portable electronic device, where the plurality of interconnecting frame portions comprise at least three frame portions, at least two of the frame portions each comprising an aperture. The security apparatus may also include a locking feature sized to fit through the apertures. Upon assembly of the interconnecting frame portions around the portable electronic device, the apertures may be aligned with each other. Upon the assembly of the interconnecting frame portions around the portable electronic device, a space may be formed between a surface of the portable electronic device and a surface of each of the at least two of the frame portions. At least two of the plurality of interconnecting frame portions may be shaped to wrap around part of a perimeter of the portable electronic device. The plurality of interconnecting frame portions may be configured to, in total, cover a substantial portion of a back of the portable electronic device when the portions are assembled around the portable electronic device. The locking feature may be coupled to a cable.

These and other embodiments of the invention are described in further detail below.

DETAILED DESCRIPTION

Embodiments of the invention are directed to security apparatuses, methods for making and using such security apparatuses, and systems using such security apparatuses. The security apparatuses can be used to prevent or deter the theft of devices such as portable electronic devices.

Figure 1:
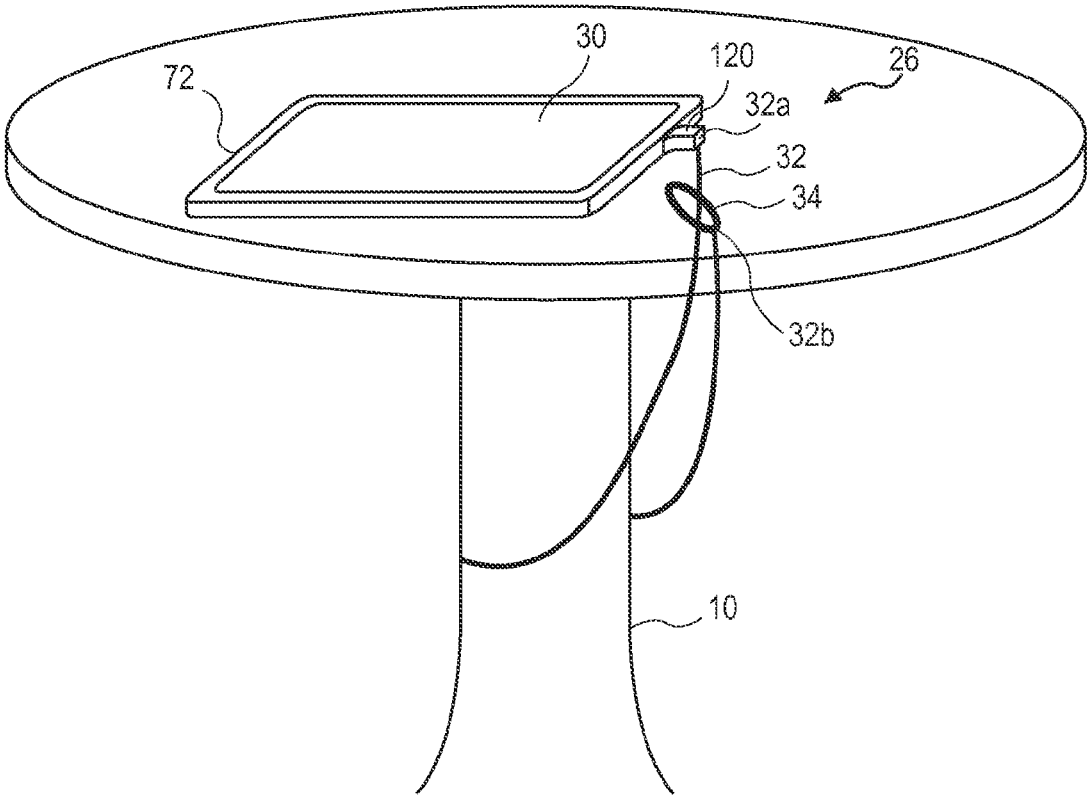
FIG. 1 shows a system according to an embodiment of the invention.

FIG. 1 shows a system comprising a portable electronic device 30 and a security apparatus 26 that is used to secure the portable electronic device 30 to an immovable object 10 such as a desk leg or the like. The security apparatus 26 includes a plurality of shell portions that are assembled by a user to at least partly encase the portable electronic device 30, thereby forming a frame 72 around the portable electronic device 30. The frame configuration may allow a user to continue to view, e.g., a screen or monitor on a front side of the portable electronic device 30 and access input components of the portable electronic device 30 even while it is secured. In other embodiments, the security apparatus may be configured to more fully or completely encase the portable electronic device 30. Such alternative configurations may be advantageous to, e.g., reduce the probability that a potential thief will spot and identify the portable electronic device 30.

The security apparatus 26 comprises a locking head 120 and a cable 32 coupled to a first end 32*a* to the locking head 120. A loop 34 is at a second end 32*b* of the cable 32. The cable 32 may comprise a strong material such as stainless steel or Kevlar™. To secure the portable electronic device 30 to the immovable object, the cable 32 may be wrapped around the immovable object and the locking head 120 may pass through the loop 34. The locking head 120 engages a portion of the frame 72, thereby coupling the cable 32 to the frame 72 and the enclosed portable electronic device 30.

Other configurations in which the security apparatus 26 (and the portable electronic device 30) may be secured to an immovable object 10 are further contemplated. FIG. 1 shows an embodiment in which the first end 32*a* of cable 32 is fixedly attached to the locking head 120 and the second end 32*b* of the cable 32 includes a loop 34 and does not directly engage with the locking head 120.

In some instances, there is no loop 34 at the second end 32*b* of the cable 32. For example, the cable 32 may be configured such that both the first end 32*a* and the second end 32*b* of the cable couple to the locking head 120. The locking head 120 may include a cable-receiving aperture. The cable 32 may then be looped around the immovable object 10 and an insertion component at the second end 32*b* may be inserted into the cable-receiving aperture, thereby locking the second end of the cable 32 to the locking head 120. Engagement of security feature, such as a key or code, with the locking head 120 may unlock the second end of the cable 32 from the locking head 120.

In some instances, each of the first end 32*a* and the second end 32*b* are coupled to a locking head 120. Each locking head 120 may engage different portions of the frame (e.g., such that two locking heads 120 may engage with two bottom portions of the frame 72).

In some instances, the second end 32*b* of the cable 32 may be configured such that it may be sandwiched between the portable electronic device 30 (and potentially the frame 72) and the locking head 120. For example, the second end 32*b* may include a flat loop. The flat loop may be positioned over an engagement portion of the frame 72, and the locking head 120 may then engage with the frame, sandwiching the loop between the locking head 120 and the frame 72.

Figure 2A:
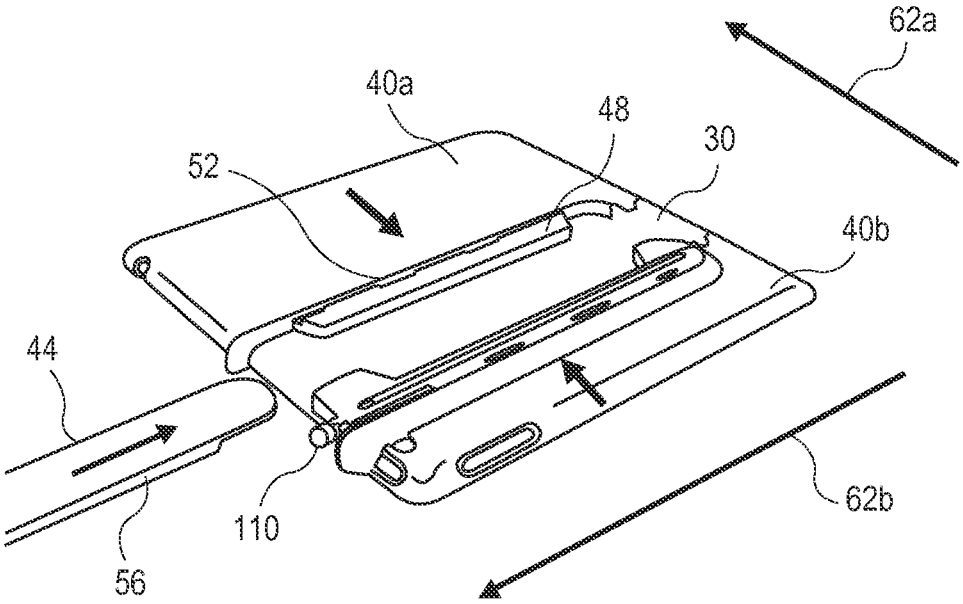
FIG. 2*a* shows a rear perspective view including a portion of a portable electronic device and parts of an unconstructed security shell according to an embodiment of the invention.

FIG. 2*a* shows a back view of a portable electronic device 30 secured by a security apparatus according to an embodiment of the invention. As shown, the security apparatus may include interlocking frame portions forming a protective shell that partly or fully encapsulating the portable electronic device 30. The frame portions may include a plurality of shell portions (e.g., a top portion 40*a* and a bottom portion 40*b*) and a connecting portion 44. The connecting portion 44 may be independent from the top and bottom portions 40*a* and 40*b* (as shown in FIG. 2*a*) or may be a part of one of the top and bottom portions 40*a* and 40*b* (e.g., a plate with an aperture hinged to one of the top and bottom portions 40*a* and 40*b*). The connecting portion 44 may include a bar, which may have a length-to-width aspect ratio between about 1.5 and 20. The top and bottom portions 40*a* and 40*b* may be configured to engage and interlock with the connecting portion 44. For example, each of the top and bottom portions 40*a* and 40*b* may include a receiving feature 48 configured to receive the connecting portion 42. A receiving feature 48 of the top portion 40*a* may be partly or substantially complementary in shape to a receiving feature 48 of the bottom portion 40*b*, such that a substantial portion (e.g., at least 80%, 90% or 95%) of a bottom edge of the top portion 40*a* is in contact with a substantial portion (e.g., at least 80%, 90% or 95%) of a top edge of the bottom portion 40*b* when the portions are fully engaged with the portable electronic device 30. In the embodiment shown in FIG. 2, the receiving features 48 are raised relative to the rest of the top and bottom portions 40*a* and 40*b*.

One or more receiving features 48 may include a track 52 to receive a runner 56 on the connecting portion 44. For example, a receiving feature 48 of the top portion 40*a* and a receiving feature 48 of the bottom portion 40*b* may include a track 52. In one embodiment, a track 52 of the top portion 40*a* is configured to combine with a track 52 of the bottom portion

40*b* to form a single combined track. In another embodiment, one or more tracks 52 are fully contained within the top portion 40*a* or the bottom portion 40*b*. In total, one, two or more tracks may be formed by the combination of the top and bottom portions 40*a* and 40*b*, and the connecting portion 44 may include one, two or more runners 56. The runners 56 can be in the form of elongated rails in some embodiments.

Figure 2B:
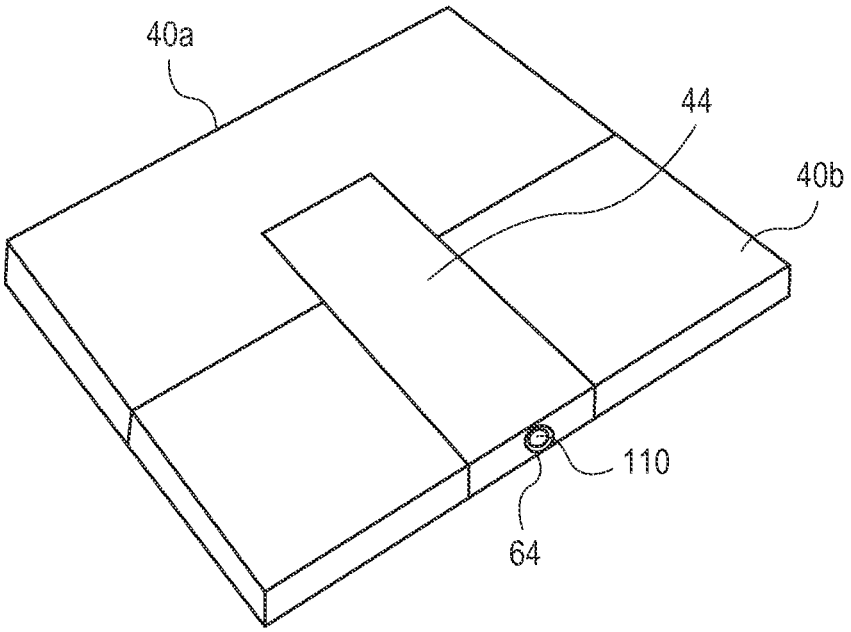
FIG. 2*b* shows a rear perspective view including a portion of a portable electronic device and parts of a constructed security shell according to an embodiment of the invention.
Figure 2C:
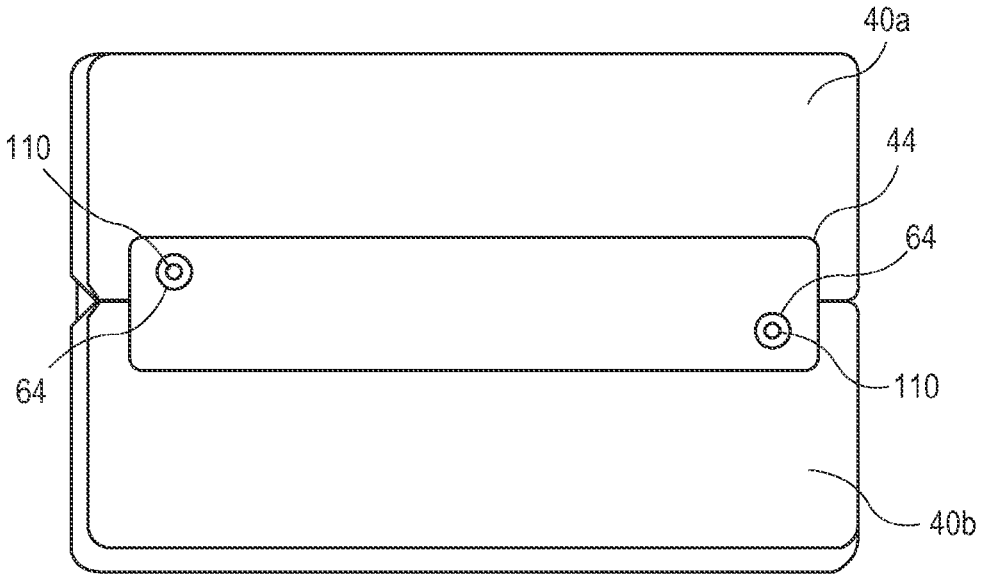
FIG. 2*c* shows a rear perspective view including a portion of a portable electronic device and parts of a constructed security shell according to an embodiment of the invention.

The top portion 40*a*, bottom portion 40*b* and connecting portion 44 may have different shapes and/or configurations in other embodiments than those shown in FIG. 2*a*. Generally, the portions may be configured such that the connecting portion 44 restrains movement of the top portion 40*a* relative to the bottom portion 40*b*, and such that locking a locking head locks the relative positions of the top portion 40*a*, bottom portion 40*b* and connecting portion 44. FIGS. 2*b* and 2*c* show back-view perspectives of alternative configurations.

FIG. 2*b* shows a back view of a portable electronic device 30 secured by a security apparatus according to another embodiment of the invention. As shown, the top portion 40*a* and bottom portion 40*b* may be slid over opposite portions of the portable electronic device 30. A user may then slide the connecting portion 44 onto the top portion 40*a* and bottom portion 40*b*. The top portion 40*a* may include a slit to receive a top region of the connecting portion 44, and may be generally perpendicularly oriented with respect to the orientation of the connecting portion 44. The connecting portion 44 may include an aperture 64. When the connecting portion 44 is engaged with the other portions, an attachment device 110 may extend through or align with the aperture 64. A locking head 120 (not shown) may then lock to the attachment device 110, either by locking to a protruding attachment device 110 or extending through the aperture to lock to a set-back attachment device 110, thereby fixing the top portion relative to the bottom portion and coupling an enclosed portable electronic device 30 to the locking head 120.

In an alternative configuration, connecting portion 44 may be hingedly attached to top portion 40*a*. The top portion 40*a* and the bottom portion 40*b* may again be slid over opposite portions of the portable electronic device 30. A user may then rotate the connecting portion 44 to extend over the bottom portion. The connecting portion 44 may include another hinge separating the two segments of the portion that are shown to be perpendicular in FIG. 2*b*. Thus, a user may then rotate the smaller segment, such that the attachment device 110 extends through the aperture 64 in the smaller segment or such that the attachment device 110 is aligned with the aperture 64. A locking head 120 (not shown) may then engage the attachment device 110 (as described above), thereby fixing the top portion relative to the bottom portion and coupling an enclosed portable electronic device 30 to the locking head 120.

FIG. 2*c* shows a back view of a portable electronic device 30 secured by a security apparatus according to yet another embodiment of the invention. Again, the top portion 40*a* and the bottom portion 40*b* may be slid over opposite sides of a portable electronic device 30. Each of the top portion 40*a* and the bottom portion 40*b* may include an attachment device 120. The connecting portion 44 includes two apertures 64, such that the connecting portion 44 can be placed over the attachment device 110. One or more locking heads 120 (not shown) may then engage the attachment devices 110 and secure the top portion 40*a*, the bottom portion 40*b* and the connecting portion 44 to each other and to a device positioned inside the portions.

The top portion 40*a*, bottom portion 40*b* and connecting portion 44 may be sized to at least partly wrap around a portable electronic device 30. Each portion may be characterized by a height dimension (extending along direction 62*a* in FIG. 2*a*) and a width dimension (extending along direction 62*b* in FIG. 2*a*). The top portion 40*a* and/or the bottom portion 40*b* may each have one dimension (e.g., a width) that is slightly larger than the same type of dimension of a corresponding portable electronic device, and may have another dimension (e.g., a height) that combines between the two to be slightly larger than the same type of dimension of a corresponding portable electronic device. In one instance, a first dimension (e.g., a width) of the top portion 40*a* and/or the bottom portion 40*b* is about 1-15, 4-12, or 9-11 inches. In one instance, a combined second dimension (e.g., a height) of the top portion 40*a* and the bottom portion 40*b* is about 1-15, 2-10, or 7-9 inches. In one instance, one of the top portion 40*a* and the bottom portion 40*b* is about 9-10 inches wide and 4-6 inches in height, and the other of the top portion 40*a* and the bottom portion 40*b* is about 9-10 inches wide and 2-4 inches in height.

The connecting portion 44 may have at least one dimension that is smaller the same type of dimension of a corresponding portable electronic device and/or smaller than the same type of dimension of one or both of the top portion 40*a* and the bottom portion 40*b*. In one instance, a first dimension (e.g., a width) of the connecting portion 44 is about 1-13, 2-11, or 8-10 inches, and a second dimension (e.g., a height) is about 0.5-7, 1-5 or 1-3 inches. In one instance, the connecting portion 44 is about 8-10 inches wide and 1-3 inches in height.

Figure 3:
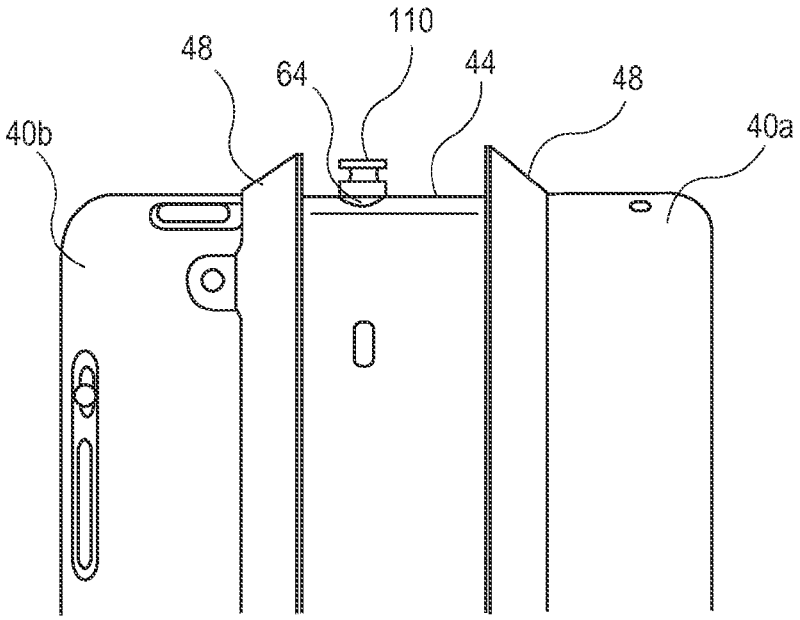
FIG. 3 shows a rear perspective view including a portion of a portable electronic device and parts of a constructed security shell.
Figure 4:
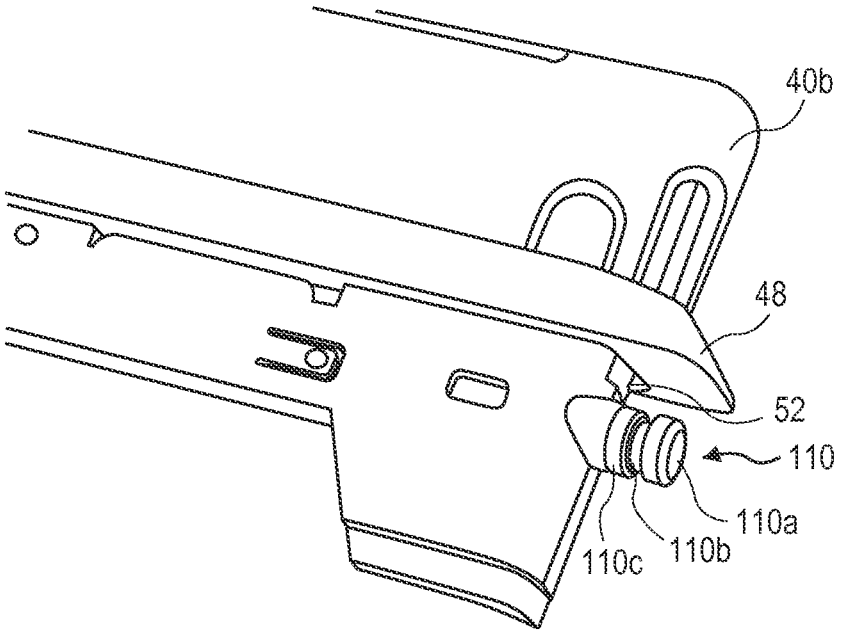
FIG. 4 shows a rear perspective of a portion of a security shell.

FIG. 3 shows the parts of the security apparatus shown in FIG. 2*a* in an interlocking constructed state. As shown, the top and bottom portions 40*a* and 40*b* may be pushed together towards a center axis of a portable electronic device. The connecting portion 44 may then engage the receiving features 48 of the top and bottom portions 40*a* and 40*b*, and thereby connects the top and bottom portions together. The top and/or bottom portion 40*a* or 40*b* may include an attachment device 110. The connecting portion may include an aperture 64 that is larger than a cross-sectional area of the attachment device 110. When the portions are engaged, the attachment device 110 may protrude out of the connecting portion's aperture 64. In other embodiments, the attachment device 110 may be set back relative to an exterior perimeter of the frame formed by the portions, FIG. 4 shows an embodiment of a bottom portion 40*b* with an attachment device 110. The attachment device 110 may be positioned on or near the receiving feature 48. The attachment device 110 may protrude laterally from a side of the bottom portion 40*b* (e.g., from a side of the receiving feature 48). In some other embodiments, the attachment device 110 may protrude outwards from a back of the bottom portion 40*b*, as shown in FIG. 2*c*. The attachment device 110 may be configured to engage a locking head. For example, the attachment device may include a recess, such as a recess 110*b* defined by a cap 110*a* and a ring structure 110*c*. The cap 110*a* and the ring structure 110*c* may have similar diameters. In some implementations, the cap 110*a* and the ring structure 110*c* may each comprise cylinders with a substantially (axially) tapered end and a substantially flat end opposite the substantially tapered end. In other implementations, one or more ends of the cap 110*a* or the ring structure 110*c* may comprise a curved surface or other uneven shape (i.e., not flat). The lateral side wall of each of the ring structure 110*c* and the cap 110*a* may be tapered (as in a cone shape) or may comprise a straight wall.

In the embodiment illustrated in FIG. 4, the cylinders comprising the ring structure 110*c* and the cap 110*a* are facing in the same direction. That is, the direction of travel from the flat end of the cap 110*a* to the tapered end of the cap 110*a* is the same direction of travel as from the flat end of the ring structure 110*c* to the tapered end of the ring structure 110*c*. That is, the cap 110*a* and the ring structure 110*c* can be axially aligned. The recess 110*b* can be formed by the space between the tapered end of the ring structure 110*c* and the flat end of the cap 110*a*, which may be joined together (and held apart to form the recess) by a central cylinder. Thus, the recess 110*b* may be located between the cap 110*a* and the ring structure 110*c*. The tapered end of the ring structure 110*c* may taper from the width of the ring structure 110*c* to the width of the central cylinder, at which point the ring structure 110*c* may be joined to the central cylinder. In some embodiments, the cap 110*a* and the ring structure 110*c* may have approximately equal lengths. In some embodiments of the invention, the central cylinder may include a lateral side wall that may be tapered or may comprise a straight wall.

In certain embodiments, the cap 110*a*, the central cylinder, and the ring structure 110*c* may be structurally discrete or non-discrete. That is, the cap 110*a*, the central cylinder, and the ring structure 110*c* may together be formed of one piece of material, such as one machined metal structure with tapered portions and a recess. In another embodiment, each of the cap 110*a*, the central cylinder, and the ring structure 110*c* may be formed separately, and joined together (such as by glue, rivets, pins, etc.). In a further embodiment, the central cylinder and either the cap 110*a* or the ring structure 110*c* may comprise one continuous material, which can be joined to the third portion. For example, the ring structure 110*c* and the central cylinder can be formed of a single machined metal part, and then be joined to the cap 110*a* by any suitable process (e.g., glue, rivets, pins, etc.).

The design of the attachment device 110, as disclosed herein, contains many advantages. For example, the flat end of the cap 110*a* (i.e., the recess-facing end) can conform to the clamping structure of a locking head. In certain embodiments, the flat end of the cap 110*a* can be a substantially planar surface that is approximately 90 degrees from the lateral side wall of the cap 110*a*. This flat end of the cap 110*a* may be approximately parallel to a side of the bottom portion 40*b*, and the flat end structure will provide a strong surface for a locking head to hold onto while securing the portable electronic device 30. A locking head is unlikely to be able to slip or be pulled off of the cap 110*a*. Furthermore, the tapered ends of the cap 110*a* and the ring structure 110*c* may assist in guiding a locking head onto the correct position around the base while securing the portable electronic device 30, resulting in easier locking and unlocking by a user (as described in further detail below). The lateral side wall(s) of the attachment device 110, such as the lateral sidewalls of the cap 110*a* and the ring structure 110*c*, may comprise a smooth surface, such as a polished metal surface. This smooth surface can allow a locking head to rotate about the attachment device, preventing a person from twisting the attachment device off the bottom portion 40*b* (i.e., forcibly unsecuring the security apparatus) by twisting the locking head. Nevertheless, attachment devices varying in design and/or operation from that described above may be used, such as those described in U.S. application Ser. No. 12/969,401, which is fully incorporated by reference.

Figure 5:
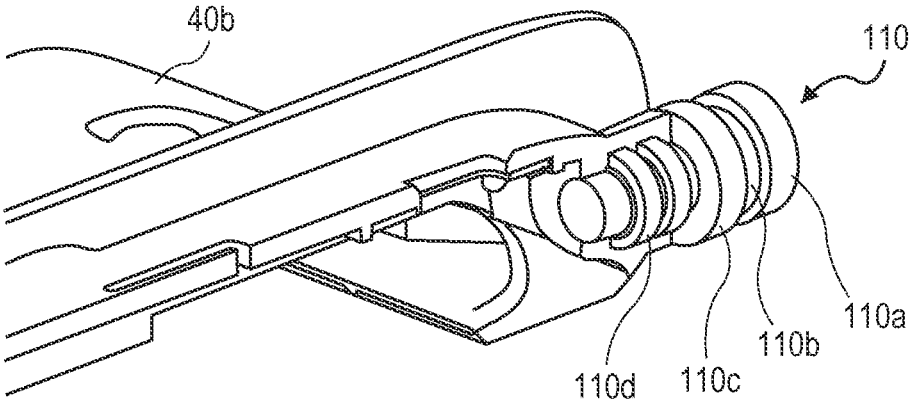
FIG. 5 shows a cross-section of a portion of a security shell.

FIG. 5 shows a cross-section of the bottom portion 40*b*. The figure shows an example of an integration of the attachment device 110 with one frame portions (e.g., the bottom portion 40*b*). In the depicted instance, the bottom portion's surface is formed around the attachment device 110. For example, plastic may be molded around the attachment device 110. The attachment device 110 may include an extension 110*d* configured to reside primarily inside a surface of the shell. The extension may be substantially cylindrical. The extension 110*d* may include ribs. The bottom portion 40*b* may include indentations, which may be positioned, spaced and/or shaped in a complementary manner to ribs of the extension 110*d*. Thus, the ribs may prevent the attachment device 110 from being separated from the bottom portion 40*b*.

FIG. 5 shows an embodiment in which the attachment device 110 is permanently integrated with the bottom portion 40*b*. In other embodiments, the attachment device 110 is an independent component that may be latched into one or more frame portions or latched into a portable electronic device 30. Additionally or alternatively, the attachment device 110 may be integrated with another frame portion (e.g., the top portion 40*a* or connecting portion 44).

Figure 6A:
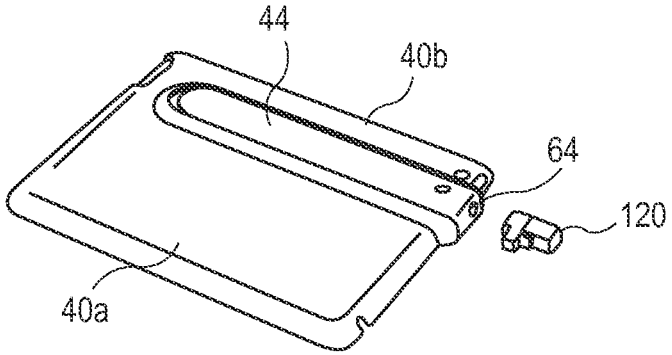
FIG. 6*a* shows a rear perspective view of a partly constructed security shell.
Figure 6B:
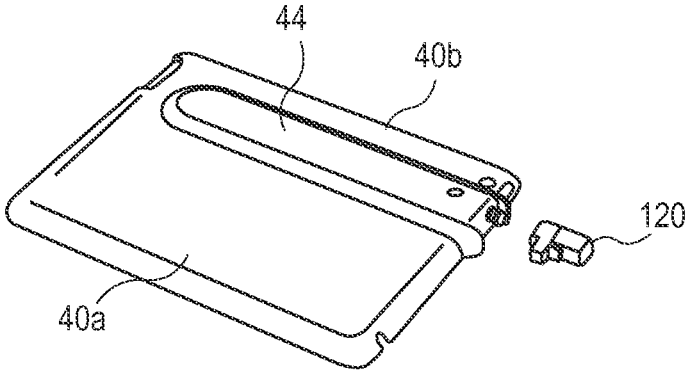
FIG. 6*b* shows a rear perspective view of a constructed and unlocked security shell.
Figure 6C:
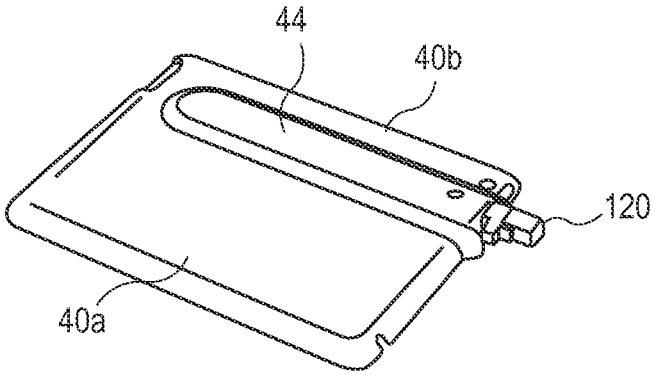
FIG. 6*c* shows a rear perspective view of a constructed and locked security shell.

FIGS. 6*a*-6*c* show exemplary operational modes of a security apparatus. In FIG. 6*a*, the connecting portion 44 is not fully engaged with the receiving features 48 of the top and bottom portions 40*a* and 40*b*. Thus, the attachment device 110 is not yet accessible. In FIG. 6*b*, the connecting portion 44 is fully engaged with the receiving features 48, and the attachment device 110 of the bottom portion 40*b* extends through the aperture 64 of the connecting portion. In FIG. 6*c*, a locking head 120 is engaged with the attachment device 110. Thus, the connecting portion 44 cannot be removed from the top and bottom portions 40*a* and 40*b* prior to disengaging the locking head 120 from the attachment device 110 (e.g., using a key).

The locking head 120 may be configured to prevent a third party from disassembling the shell's parts and/or removing the portable electronic device 30 from one or more frame portions. The locking head 120 may be configured to attach to the attachment device 110, e.g., by locking around the cap 110*a*. The locking head 120 may be configured to release the attachment device 110 upon entry of a security feature, such as insertion of a key 121 into the locking head 120 or entry of a code into the locking head 120.

Figure 7A:
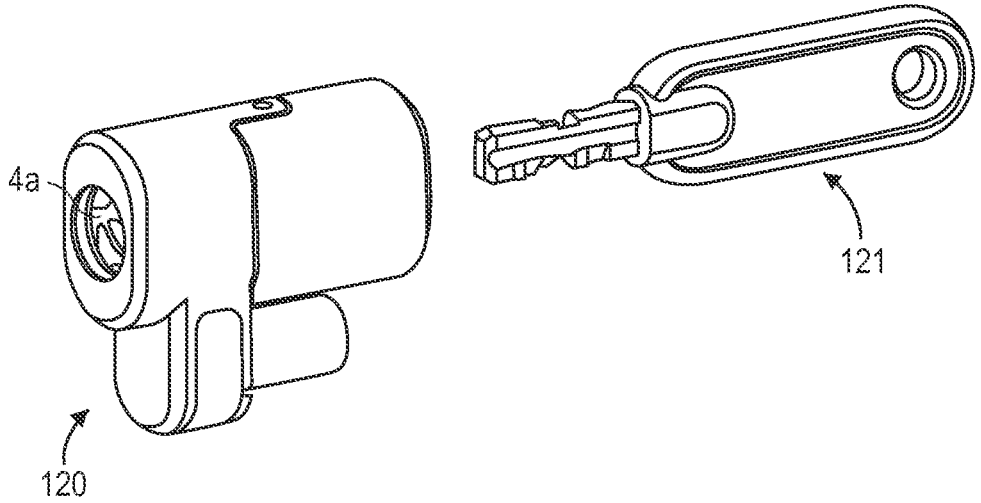
FIG. 7*a* shows a front perspective view of a key and a locking head.
Figure 7B:
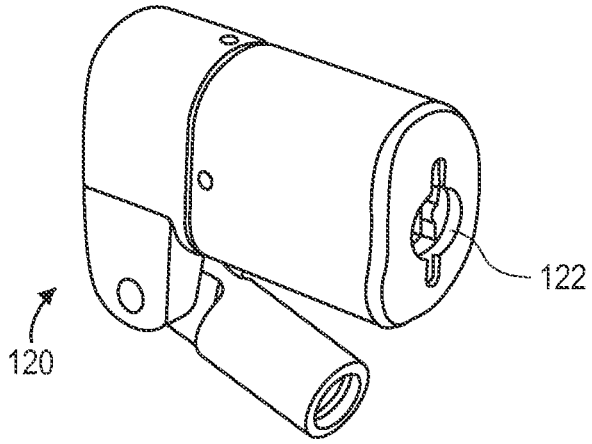
FIG. 7*b* shows a rear perspective view of a locking head.

FIG. 7*a* shows an exploded view of one exemplary locking head 120 and key 121. A front hole 4*a* in the head 120 may be configured to receive a cap 110*a* in the attachment device 110. The head 120 may include any suitable dimensions, e.g., having a length, height and/or width of about 5-50 mm. FIG. 7*b* shows a rear perspective view of the head 120. A keyhole 122 is at a rear section of the head 120. Locking heads and/or keys varying in design and/or operation from that described above may be used, such as those described in U.S. application Ser. No. 12/969,401, which is fully incorporated by reference.

Figure 8:
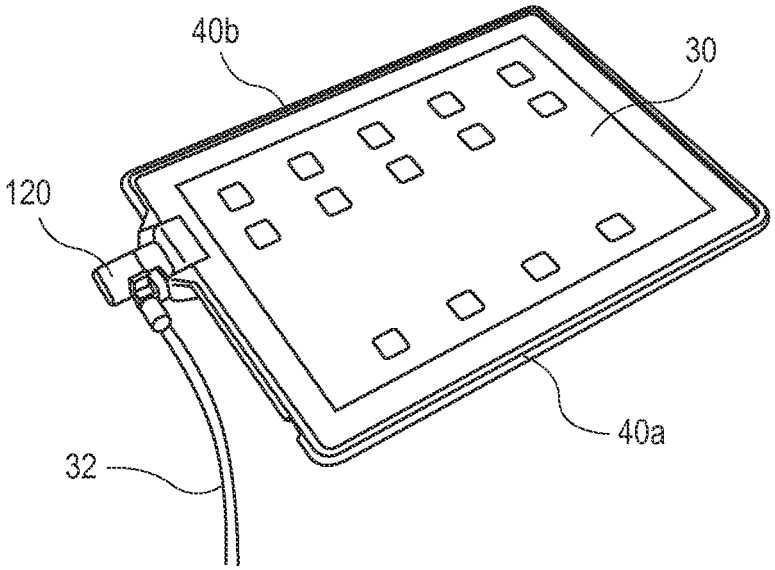
FIG. 8 shows a front perspective of a constructed and locked security shell.

FIG. 8 shows a front view of a portable electronic device 30 secured by a security apparatus according to an embodiment of the invention. One or more shell portions (e.g., top and bottom portions 40*a* and 40*b*) may be configured to wrap around the portable electronic device 30. The combined shell portions may form a full or partial frame around the portable electronic device 30. Thus, when the shell portions are locked in this position (e.g., by coupling the shell portions via a connecting portion and engaging a locking feature), a third party may be prevented from separating the portable electronic device 30 from the shell and from the locking head 120. A width of the created frame may be, e.g., about 0.5-5 cm. Thus, a user of the device 30 may still be able to use the device while the security apparatus is in operation. The frame portions may be configured to cover all of the back of the portable electronic device (e.g., as shown in FIGS. 6*a*-6*c*) or to cover distinct regions (e.g., corresponding to the device's motherboard) to prevent third parties from stealing valuable parts of the portable electronic device from the back. In some instances, the connecting portion 44 is positioned on at least a portion of a valuable device component (e.g., a motherboard). Thus, an attempt to forcibly separate the connecting portion 44 from the other portions 40*a* and 40*b* is reasonably likely to damage the portable electronic device. The locking head 120 may be attached to a cable 32, which may be looped around or attached to a semi-permanent or permanent structure, as shown, e.g., in FIG. 1. In this manner, a portable electronic device 30 may be securely coupled to a fixed location.

FIGS. 2*a*-2*c* illustrate a variety of configurations in which a locking feature may be extended through an aperture 64 in a frame portion. In some instances, another frame portion includes an attachment device 110 that extends through the aperture 64 or is aligned with the aperture 64 when the portions are in an engaged state. A locking head 120 may then extend through the aperture 64 to lock to an aligned attachment device 110 or may lock to an attachment device 110 protruding through the aperture 64. Thus, the above figures illustrate embodiments in which at least one of two engagable locking features (e.g., attachment device 110 or locking head 120) extend through an aperture 64 in a frame portion. In other embodiments, a locking feature extends through one or more apertures and can lock the frame portions relative to each other without engaging with another complementary locking feature. An example of this configuration is described with respect to FIGS. 9-11.

Figure 9:
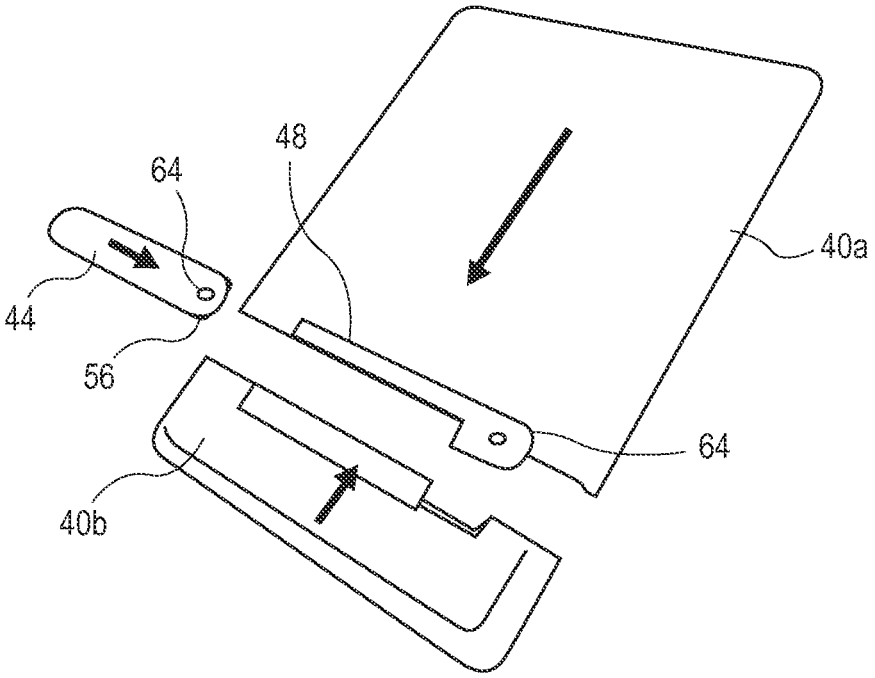
FIG. 9 shows a rear perspective view of an unconstructed security shell according to an embodiment of the invention.

FIG. 9 shows parts of a security apparatus according to another embodiment of the invention. In this embodiment, the raised receiving features 48 of the top and bottom portions 40*a* and 40*b* are present at substantially the same lateral positions. In FIG. 9, the raised receiving features do not extend to the ends of the portions in the lateral direction. In some embodiments, only one portion has receiving features at a lateral position surrounding the aperture 64', while in other instances, this is not the case (e.g., and both portions may include an aperture). The connecting portion 44 may again include runners that may be configured to straddle the receiving features 48.

One or more of the frame portions may include an aperture. FIG. 9 shows an embodiment in which the connecting portion 44 includes an aperture 64 and the top portion 40*a* includes an aperture 64'. The apertures may be configured to substantially overlap upon full construction of the portions.

Figure 10:
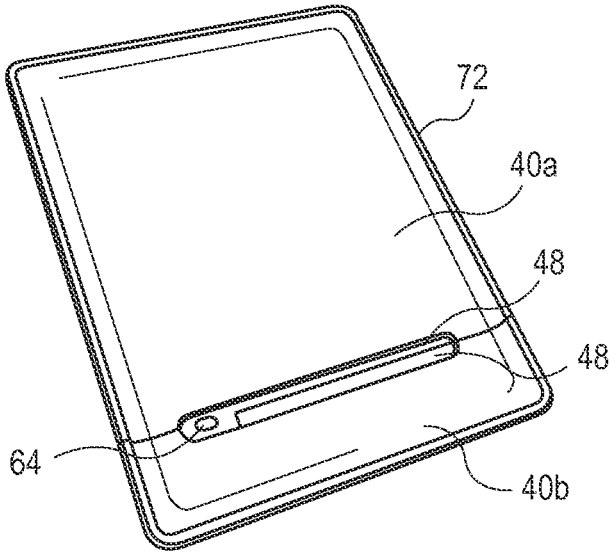
FIG. 10 shows a front perspective view of a constructed security shell.

FIG. 10 shows a front view of the constructed and interlocked parts (with the electronic device 30 not being shown). As shown, the portions' receiving features 48 may form a depression from this angle. The portions may be shaped to wrap around a device and, in essence, form a frame 72 around the device.

Figure 11:
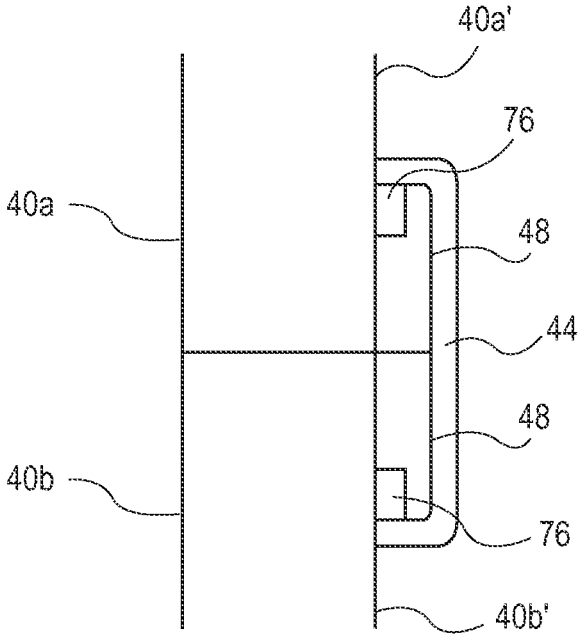
FIG. 11 shows a side perspective view of a constructed security shell.

FIG. 11 shows a side view of an embodiment of the security apparatus shown in FIGS. 9-10. The top and bottom portions 40*a* and 40*b* may be positioned to be directly adjacent to each other. The receiving features 48 may comprise an L-shape, such that the combination of the top and bottom portions' receiving features 48 form a T-shape. Thus, spaces 76 may be formed between the receiving features 48 and primary surfaces 40*a*' and 40*b*' of the top and bottom portions.

In operation, the connecting portion 44 may be slid over the receiving features 48 of the top and bottom portions 40*a* and 40*b*, such that an aperture 64 of the connecting portion 44 is aligned with an aperture 64' of one or both of the top and bottom portions 40*a* and 40*b*. A locking feature (e.g., independent from any frame portion) may be inserted into the overlapping apertures. The locking feature may include, e.g., an attachment mechanism which may physically move (e.g., rotate, expand and/or translationally move) when entering a locked state. Thus, a user may insert the locking feature (that may be, e.g., attached to a cable) through the apertures, and cause the attachment mechanism to enter the locked state. The locking-state movement of the attachment mechanism may prevent a thief from pulling the attachment mechanism back through the apertures to thereby decouple frame (that at least partly encloses a portable electronic device) from the attachment mechanism. Because the attachment mechanism may be coupled to a cable looped around an immovable object, this design may prevent the thief from stealing the portable electronic device.

The attachment mechanism may include, e.g., a configuration disclosed in U.S. Pat. No. 7,121,125, which is hereby incorporated by reference in its entirety. In one embodiment, the attachment mechanism comprises a T-bar lock. The aperture may be sized and shaped such that it may receive a crossmember of the T-bar only when the crossmember is in a particular orientation (e.g., horizontally and not vertically). The T-bar may be appropriately oriented and the crossmember inserted through the apertures. The T-bar may then be rotated and locked in the rotated position. Thus, it may not be possible to pull the crossmember of the T-bar back through the aperture without first unlocking the T-bar lock. Further, because the crossmember extends through apertures in two frame portions, the two frame portions are locked together.

The locking feature (e.g., T-bar lock) may be connected to a cable that may be wrapped around a semi-permanent or permanent fixture. Entry of a security feature (e.g., a key) into the locking feature may again allow for the locking feature to be pulled back through the aperture and thereby allow the portable electronic device 30 to be removed from the frame portions.

In some embodiments, a security apparatus may include more than one of the above-described embodiments. For example, the embodiment shown in FIG. 2*a* may also include complementary apertures in the connecting bar 44 and the bottom portion 40*b* which may be sized and positioned to receive a T-bar lock. A user could then choose to engage an attachment device 110 extending through an aperture with a locking head and/or to insert another attachment mechanism (e.g., a T-bar lock) through aligned apertures.

Top portion 40*a*, bottom portion 40*b* and/or connecting portion 44 may comprise, e.g., a plastic, metal, or microfiber material. A material may one that would protect the portable electronic device 30, provide traction on an outer surface, and/or allow the device to easily slide along an inner surface.

A security apparatus may include additional features. For example, a constructed security apparatus may include a hinged stand support, such that a user may prop an enclosed portable electronic device at an angle. In one instance, the hinged stand support is included on one of the bottom or top portions. In one instance, a connecting portion 44 may serve as or include a hinged stand support. For example, in FIG. 2*b*, the connecting portion 44 may be able to serve as a hinged stand support when not fully rotated to be flush with the back surfaces of the top and bottom portions.

Figure 12:
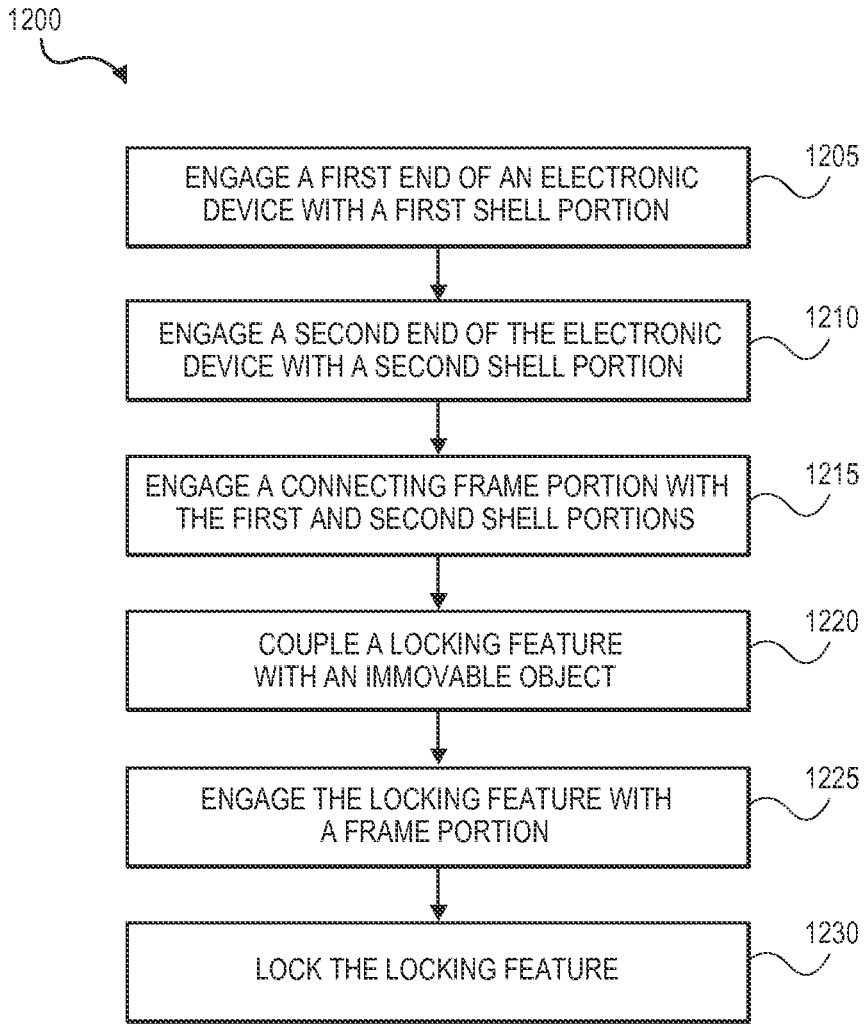
FIG. 12 shows a flowchart illustrating a method of using a security apparatus according to an embodiment of the invention.

FIG. 12 shows a flowchart illustrating a method 1200 of using a security apparatus according to an embodiment of the invention. At block 1205, a first end of a portable electronic device is engaged with a first shell portion. For example, a top shell portion 40*a* may be slid onto a top of a portable electronic device 30. The first shell portion may be shaped such that it partly wraps around a portable electronic device upon engagement (e.g., contacting two opposite sides of the portable electronic device, a front and/or back of the portable electronic device, and a top of the portable electronic device).

At block 1210, a second end of the portable electronic device is engaged with a second shell portion. For example, a bottom shell portion 40*b* may be slid onto a bottom of the portable electronic device 30. The second end of the portable electronic device may be opposite the first end of the portable electronic device. The second shell portion may be shaped such that it partly wraps around a portable electronic device upon engagement (e.g., contacting two opposite sides of the portable electronic device, a front and/or back of the electronic device, and a bottom of the portable electronic device).

At block 1215, a connecting frame portion is engaged with the first and second shell portions. For example, a connecting frame portion 44 may be slid over part of the top shell portion 40*a* and part of the bottom shell portion 40*b*. Tracks 52 of the top and bottom shell portions 40*a* and 40*b* may receive runners 56 of the connecting portion 44, one or more apertures 64 of the connecting portion 44 may extend over a locking head 110 coupled to (e.g., integrated into) the top portion 40*a* and/or bottom portion 40*b*, etc. As another example, a connecting frame portion 44 may be placed or rotated onto part of the top shell portion 40*a* and part of the bottom shell portion 40*b*. In some instances, one or more apertures 64 in connecting portion 44 may extend over, e.g., one or more attachment devices 110 coupled to the top and/or bottom portions 40*a* and 40*b*.

At block 1220, a locking feature (e.g., a locking head, attachment mechanism or T-bar) is coupled with an immovable object. For example, a cable 32, U-bar, etc., that is coupled to a locking feature (e.g., a locking head 120) may be wrapped around an immovable object 10. In some instances, a cable 32 is wrapped around an immovable object 10, and one end of the cable 32 (e.g., the end attached to the locking feature) is inserted through a loop 34 at the other end of the cable 32.

At block 1225, the locking feature is engaged with a frame portion. For example, a locking head 120 may engage with (e.g., and lock to) an attachment device 110 coupled to or integrated into a frame portion (e.g., a top portion 40*a*, a bottom portion 40*b* or a connecting portion 44). As another example, a crossmember on a T-bar lock may extend through an aperture in each of one or more frame portions, may rotate, and then may lock in the rotated position (thereby preventing reverse removal through the aperture(s)). In some embodiments, engagement of the locking feature with the frame portion sandwiches an intermediate component between the locking feature and the frame portion. For example, a frame portion (e.g., the connecting portion 44) may include an aperture 64 that may be positioned over the attachment device 110 coupled to another frame portion (e.g., the bottom shell portion 40*b*) prior to engaging an attachment device 110 with a locking head 120. The engagement of the locking head 120 with the attachment device 110 may then restrict the movement of the two portions relative to each other. The two portions may be engaged with any other portions (e.g., with the top portion 40*a*), such that engagement of the locking head serves to restrain movement of all portions relative to each other (thereby locking an electronic device within the combined portions) and secures the portions (and electronic device) to the immovable object.

Figure 13:
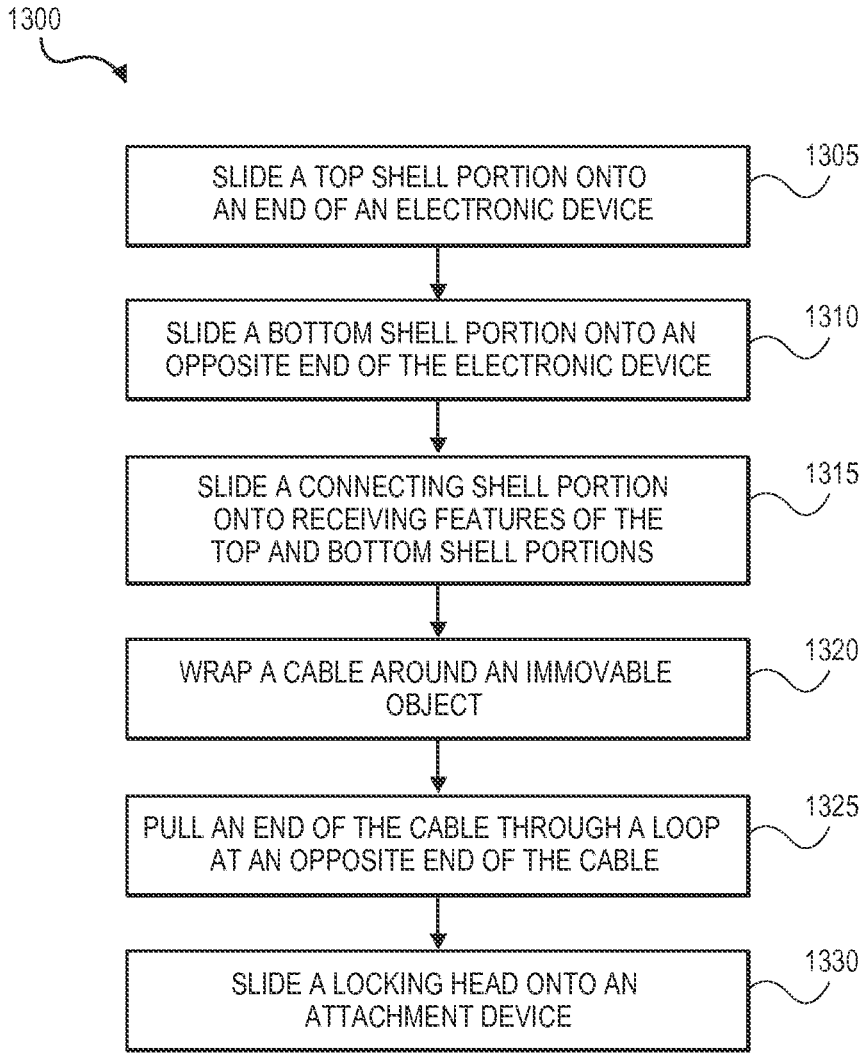
FIG. 13 shows a flowchart illustrating a method of using a security apparatus according to an embodiment of the invention.

FIG. 13 shows a flowchart illustrating a method 1300 of using a security apparatus according to an embodiment of the invention. At block 1305, a top shell portion 40*a* is slid onto a first end of a portable electronic device 30. At block 1310, a bottom shell portion 40*b* is slid onto a second, opposite end of the portable electronic device 30. At this point, the top and bottom shell portions 40*a* and 40*b* may form a frame 72 or complete enclosure around the portable electronic device.

At block 1315, a connecting frame portion 44 is slid onto receiving features 48 of the top and bottom shell portions 40*a* and 40*b*. Specifically, runners 56 of the connecting portion may be received by tracks 52 of in the receiving features 48 of the top and bottom portions 40*a* and 40*b*, such that top-to-bottom movement of the top and bottom portions is restricted relative to each other (e.g., preventing the top portion 40*a* from separating from the bottom portion 40*b* so long as the connecting portion is engaged).

The connecting frame portion 44 may include an aperture 64. After the connecting frame portion 44 is fully slid onto the receiving features 48 of the top and bottom shell portions, the aperture 64 may extend over at least part of an attachment device 110 coupled to (e.g., integrated within) the bottom shell portion 40*b*.

At block 1320, a cable 32 is wrapped around an immovable object 10, such as a desk leg. The immovable object 10 need not literally be immovable, but may be sufficiently stationary, heavy or ground-attached to make it difficult to slide a wrapped cable 32 off of the object 10.

At block 1325, a first end 32*a* of the cable 32 is pulled through a loop 34 at a second opposite end 32*b* of the cable 32. Thus, a larger loop is formed in the cable which loops around the immovable object 10. The first end 32*a* may be coupled to a locking head 120.

At block 1330, a locking head 120 coupled to the first end 32*a* of the cable 32 may be slid onto an attachment device 1330 coupled to a frame portion (e.g., integrated into the bottom portion 40*b*). Upon application of sufficient pressure on the locking head 120, the locking head 120 may lock onto the attachment device 110 coupled to the bottom portion 40*b*, thereby securing the bottom portion 40*b* to the immovable object 10. Further, the connecting portion 44 is secured to the immovable object 10, as part of the connecting portion (adjacent to its aperture 64) is sandwiched between the attachment device 110 and the locking head 120). Further, the top portion 40*a* is secured to the immovable object 10, as the connecting portion 44 prevents the separation of the top portion 40*a* from the bottom portion 40*b*. Finally, the electronic device 30 is secured to the immovable object 10, as the frame 72 formed by the top and bottom portions 40*a* and 40*b* prevents removal of the portable electronic device 30 from the frame portions.

The above description is illustrative and is not restrictive. Many variations of the invention will become apparent to those skilled in the art upon review of the disclosure. The scope of the invention should, therefore, be determined not with reference to the above description, but instead should be determined with reference to the pending claims along with their full scope or equivalents.

One or more features from any embodiment may be combined with one or more features of any other embodiment without departing from the scope of the invention. Where approximate or "about" is described for measurements, embodiments herein also contemplate the exact measurement. Where a shape is disclosed, such as a cylinder, embodiments herein contemplate other suitable shapes, such as multi-sided blocks (octagonal structures, decagonal structures, etc.), other rectangular structures, etc. In certain implementations, structures with multiple sides approaching the shape of cylinders, as well as substantially cylindrical shapes (e.g., a cylinder with a flat sidewall portion) may be considered cylinders as described herein, unless otherwise specified.

A recitation of "a", "an" or "the" is intended to mean "one or more" unless specifically indicated to the contrary.

What is claimed is:

1. A security apparatus for a portable electronic device having a front and a back, the front of the portable electronic device including a screen, the security apparatus comprising:

a plurality of interconnecting frame portions that assemble to interconnect and at least partly enclose the portable electronic device, two of the plurality of interconnecting frame portions each defining an aperture; and a locking feature sized to fit through the apertures;

wherein, upon assembly of the plurality of interconnecting frame portions around the portable electronic device, the apertures are aligned with each other;

wherein the plurality of interconnecting frame portions are configured to, in total, cover a substantial portion of the back of the portable electronic device when the interconnecting frame portions are assembled around the portable electronic device; and wherein the plurality of interconnecting frame portions are configured to wrap around an entire perimeter of the portable electronic device.

2. The security apparatus of claim 1, wherein the plurality of interconnecting frame portions includes a first portion and a second portion that is disconnectable from the first portion.

3. The security apparatus of claim 2, wherein the plurality of interconnecting frame portions includes a third portion that is disconnectable from the first and second portions.

4. The security apparatus of claim 1, wherein the locking feature is configured to be connected to an immovable object.

5. The security apparatus of claim 4, wherein the locking feature is coupled to a cable.

6. The security apparatus of claim 4, wherein the locking feature includes an attachment device.

7. The security apparatus of claim 4, wherein the locking feature includes a locking head.

8. The security apparatus of claim 4, wherein the locking features includes a T-bar.

9. The security apparatus of claim 1, wherein one of the plurality of interconnecting frame portions includes a receiving feature that engages a portion of another of the plurality of interconnecting frame portions.

10. The security apparatus of claim 9, wherein the receiving feature includes a track that receives a runner of the another of the plurality of interconnecting frame portions.

11. The security apparatus of claim 1, wherein one of the plurality of interconnecting frame portions includes a slot that receives a portion of another of the plurality of interconnecting frame portions.

12. A security apparatus for a portable electronic device, the security apparatus comprising:

a plurality of she portions that assemble to at least partly encase the portable electronic device, the plurality of shell portions including a first portion and a second portion that couple together to form a frame around an entire perimeter of the portable electronic device;

a locking feature coupled to one of the plurality of shell portions, the locking feature operable to releasably secure the plurality of shell portions together; and an attachment device extending from one of the plurality of shell portions into an aperture in another of the plurality of shell portions, wherein the plurality of shell portions further includes a third portion that defines the aperture;

wherein the portable electronic device is usable when encased by the plurality of shell portions.

13. The security apparatus of claim 12, wherein the locking feature engages the attachment device.

14. The security apparatus of claim 13, wherein the attachment device includes a generally cylindrical boss protruding from the one of the plurality of shell portions.

15. The security apparatus of claim 12, wherein the plurality of shell portions are configured to, in total, cover a substantial portion of a back of the portable electronic device when the plurality of shell portions is assembled around the portable electronic device.

16. The security apparatus of claim 12, wherein the first portion and the second portion, when assembled together, have a height dimension and a width dimension, and wherein the height and width dimensions are slightly larger than corresponding dimensions of the portable electronic device.

17. The security apparatus of claim 12, wherein the locking feature includes a locking head and a cable, and wherein the cable is configured to be secured to an immovable object.

* * * * *